US011850609B2

(12) United States Patent
McCutcheon

(10) Patent No.: US 11,850,609 B2
(45) Date of Patent: Dec. 26, 2023

(54) SHOWER HEAD

(71) Applicant: Methven Limited, Avondale (NZ)

(72) Inventor: Stephen McLay McCutcheon, Auckland (NZ)

(73) Assignee: METHVEN LIMITED, Avondale (NZ)

( * ) Notice: Subject to any disclaimer, the term of this patent is extended or adjusted under 35 U.S.C. 154(b) by 153 days.

(21) Appl. No.: 17/194,903

(22) Filed: Mar. 8, 2021

(65) Prior Publication Data

US 2021/0187522 A1 Jun. 24, 2021

Related U.S. Application Data

(63) Continuation of application No. 14/387,472, filed as application No. PCT/NZ2013/000047 on Mar. 22, 2013, now abandoned.

(30) Foreign Application Priority Data

Mar. 23, 2012 (NZ) ..... 599011

(51) Int. Cl.
*B05B 1/18* (2006.01)
*B05B 1/26* (2006.01)
*B05B 1/04* (2006.01)

(52) U.S. Cl.
CPC ..... *B05B 1/185* (2013.01); *B05B 1/044* (2013.01); *B05B 1/267* (2013.01); *B05B 1/18* (2013.01)

(58) Field of Classification Search
CPC .. B05B 1/04; B05B 1/044; B05B 1/18; B05B 1/185; B05B 1/262; B05B 1/265; B05B 1/267; B05B 1/26
USPC ..... 239/504, 520, 522, 524, 498, 502, 503, 239/505, 507–519, 556–560, 521, 523
See application file for complete search history.

(56) References Cited

U.S. PATENT DOCUMENTS

| | | | | |
|---|---|---|---|---|
| 2,044,445 | A | 6/1936 | Price | |
| 2,900,139 | A * | 8/1959 | Hensley, Jr. | E03C 1/086 4/615 |
| 2,998,934 | A * | 9/1961 | Broughton | B05B 1/267 239/536 |
| 3,580,513 | A | 5/1971 | Martin | |
| 3,893,628 | A | 7/1975 | McCollum | |
| 4,013,230 | A | 3/1977 | Gondek | |
| 4,130,247 | A * | 12/1978 | Healy | B05B 1/30 239/533.1 |
| 4,522,716 | A * | 6/1985 | LaValley | B01D 33/60 210/402 |
| 5,253,811 | A | 10/1993 | Sieth | |
| 5,445,322 | A | 8/1995 | Formhals et al. | |
| 6,119,965 | A | 9/2000 | Chang | |

(Continued)

FOREIGN PATENT DOCUMENTS

| | | | |
|---|---|---|---|
| DE | 102005030803 | A1 | 1/2007 |
| WO | 9600617 | A1 | 1/1996 |

*Primary Examiner* — Cody J Lieuwen
(74) *Attorney, Agent, or Firm* — Dykema Gossett PLLC

(57) ABSTRACT

A spray head has an inlet in fluid communication with a plurality of nozzles. The nozzles are adapted to produce, in use, a jet of fluid which is directed toward a respective impingement surface portion. The jet of fluid impacts on the respective impingement surface portion and breaks into a stream of droplets. The stream of droplets has an elongate transverse cross-section.

23 Claims, 11 Drawing Sheets

(56) References Cited

U.S. PATENT DOCUMENTS

| | | | | |
|---|---|---|---|---|
| 6,557,785 | B1 * | 5/2003 | Knapp | B05B 1/265<br>239/311 |
| 6,789,749 | B2 | 9/2004 | Liu | |
| 7,959,088 | B2 | 6/2011 | Bolus et al. | |
| 8,733,675 | B2 | 5/2014 | Leber | |
| 2001/0023901 | A1 | 9/2001 | HaverStraw et al. | |
| 2003/0209614 | A1 | 11/2003 | Liu | |
| 2008/0048054 | A1 * | 2/2008 | Peters | A61M 11/042<br>29/890.07 |

* cited by examiner

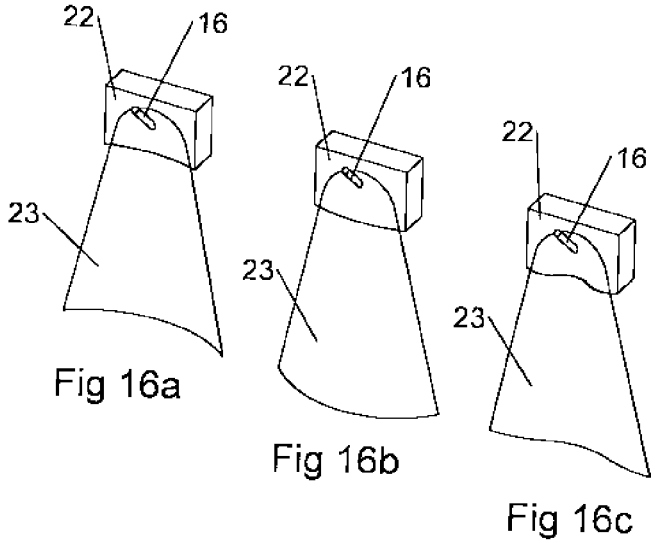
Fig 16a
Fig 16b
Fig 16c
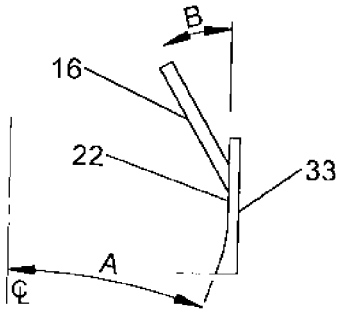
Fig 17
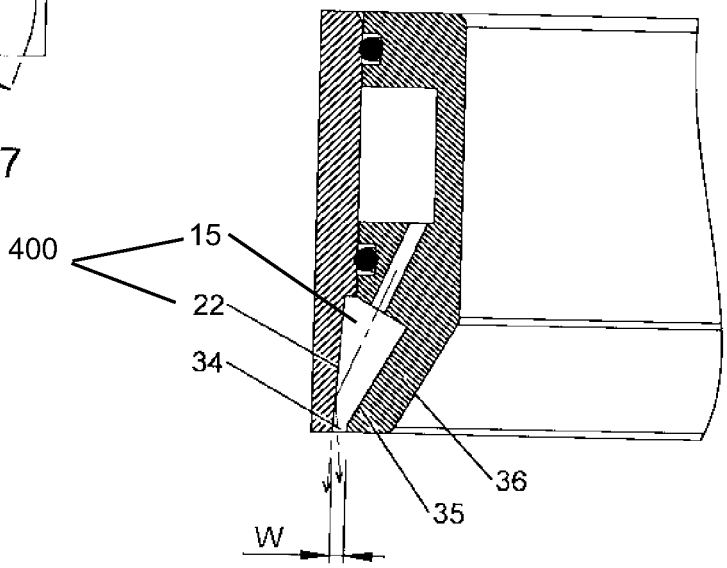
Fig 18

SHOWER HEAD

CROSS-REFERENCE TO RELATED APPLICATIONS

This application is a continuation of U.S. application Ser. No. 14/387,482, filed 23 Sep. 2014, which is a national stage filing based upon International application No. PCT/NZ2013/000047, filed 22 Mar. 2013, which claims the benefit of priority to New Zealand application No. 599011, filed 23 Mar. 2012.

BACKGROUND TO THE INVENTION

The present invention relates to spray heads for producing a spray of fluid and may have particular application to a shower head.

Shower heads of the prior art are typically provided with a plurality of apertures from which a stream of water issues. A problem with such shower heads of the prior art is that they often do not provide a satisfactory spray when used at low flow rates.

The applicant has discovered that many users prefer the sensation of much smaller droplets of water than are created by the shower heads of the prior art. The applicant's International Publication No. WO2004/101163 describes a shower head which has groups of two or more nozzles which are arranged such that jets of water issuing from the nozzles collide and break into smaller droplets. This arrangement works well, and is particularly advantageous when used at low flow rates.

Another method used by the prior art to create smaller droplets is to direct the stream of water from each nozzle onto a surface of the shower head so that it breaks up into relatively small droplets. However, a problem with many prior art shower heads of this type is that they either provide a spray pattern which is too small, or one which has a central area which has little or no coverage.

OBJECT

It is an object of the present invention to provide a spray head and/or a showerhead which will overcome or ameliorate problems with such spray heads/showerheads at present, or which will at least provide a useful choice.

BRIEF SUMMARY OF THE INVENTION

According to one aspect of the present invention there is provided a spray head comprising an inlet in fluid communication with a plurality of nozzles, each nozzle adapted to produce, in use, a jet of fluid which is directed toward a respective impingement surface portion, wherein each jet of fluid impacts on the respective impingement surface portion and breaks into a stream of droplets, each stream of droplets having an elongate transverse cross-section.

Preferably the angle between the jet of fluid and the respective impingement surface portion is between 10 degrees and 40 degrees.

Preferably the jet of fluid impacts on the impingement surface portion between 1 mm and 14 mm from an edge of the impingement surface portion.

Preferably each stream of droplets travels through an aperture in the spray head.

Preferably the streams of droplets are substantially unimpeded by the aperture.

Preferably the aperture comprises a slot.

Preferably the aperture has a width of substantially 3 mm or less.

Preferably the elongate transverse cross section of each stream of droplets has a longitudinal axis, and the longitudinal axes of at least two of the streams of droplets are substantially parallel to each other.

Preferably the longitudinal axes of each said stream of droplets are substantially parallel.

Preferably each said stream of droplets has a geometric centreline, and the geometric centrelines of at least two of the streams of droplets are substantially parallel to each other.

Preferably each said stream of droplets has a geometric centreline, and the geometric centrelines of at least two of the streams of droplets are substantially divergent.

Preferably a plurality of said impingement surface portions form part of a single impingement surface.

Preferably each said impingement surface portion is part of a single impingement surface.

Preferably the spray head comprises a first set of a plurality of nozzles and a second set of a plurality of nozzles, each nozzle in the first set of nozzles directed towards a respective first impingement surface portion and each nozzle in the second set of nozzles directed towards a respective second impingement surface portion, wherein, in use, jets of fluid issuing from the nozzles impact on the respective impingement surface portions and break into a stream of droplets, wherein the nozzles and impingement surface portions are configured such that the geometric centrelines of the streams of droplets from the first impingement surface portions converge, and the geometric centrelines of the streams of droplets from the second impingement surface portions are non-convergent.

Preferably the geometric centrelines of the streams of droplets from the second impingement surface portions are substantially parallel.

Preferably the geometric centrelines of the streams of droplets from the second impingement surface portions are substantially divergent.

Preferably the geometric centrelines of the streams of droplets from the second impingement surface portions are substantially parallel, and the spray head comprises a third set of a plurality of nozzles, each nozzle in the third set of nozzles directed towards a respective third impingement surface portion, wherein, in use, jets of fluid issuing from the third set of nozzles impact on the respective impingement surface portions and break into a stream of droplets, wherein the third set of nozzles and impingement surface portions are configured such that the geometric centrelines of the streams of droplets are substantially divergent.

Preferably the nozzles are arranged along a notional curved line, the nozzles arranged such that a jet of fluid issuing, in use, from at least some of said nozzles has a direction which includes a component which is substantially tangential to the notional curved line.

Preferably the nozzles are arranged along a notional curved line, and wherein the elongate transverse cross section of each stream of droplets has a longitudinal axis, and the longitudinal axis of each stream of droplets is non-tangential to the notional curved line.

Preferably the notional curved line is substantially elliptical or semi-elliptical. Preferably the notional curved line is substantially circular or semi-circular. Preferably the notional curved line is a simple closed curve.

Preferably the spray head comprises an outer housing having an annular portion and a handle portion.

Preferably the spray head comprises an annular body engaged with the annular portion of the housing, wherein the nozzles are defined by apertures in the annular body.

Preferably the spray head comprises an impingement surface member engaged with the annular housing.

Preferably the slot is defined in part by the annular body.

According to a second aspect of the present invention there is provided a spray head comprising a plurality of spray stream generating formations arranged along a notional curved line, each spray stream generating formation adapted to produce a stream of droplets in use, each stream of droplets having an elongate transverse cross-section which has a longitudinal axis, wherein the longitudinal axis of each said stream of droplets is non-tangential to the notional curved line.

According to a third aspect of the present invention there is provided a spray head comprising a plurality of spray stream generating formations arranged along a notional curved line, each spray stream generating formation adapted to produce a stream of droplets in use, each stream of droplets having a geometric centreline and an elongate transverse cross-section, wherein a first portion of the spray streams have convergent geometric centrelines and a second portion of the spray streams have non-convergent geometric centrelines.

According to a fourth aspect of the present invention there is provided a spray head comprising a plurality of nozzles, each nozzle adapted to produce, in use, a jet of fluid which is directed toward a respective impingement surface portion, wherein each jet of fluid impacts on the impingement surface portion and breaks into a stream of droplets.

According to a further aspect of the present invention there is provided a shower head substantially as herein described with reference to any one or more of the accompanying figures.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

7*a* is a diagrammatic front view of the annular portion of the shower head of another embodiment of the present invention, showing the droplet streams issuing from one impingement surface portion, the other droplets streams having been omitted for clarity.

Figure 7A:
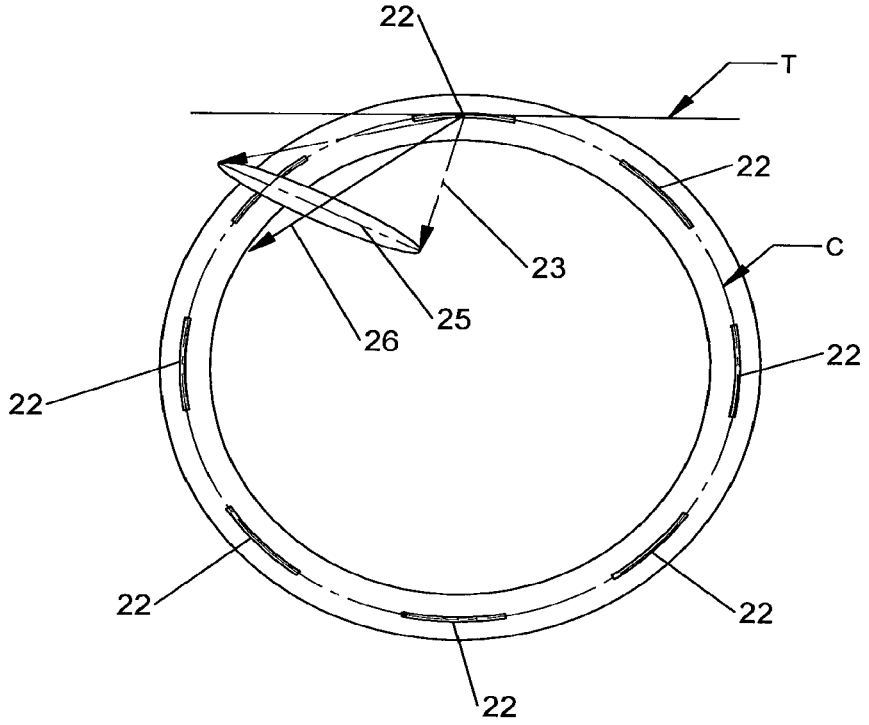
Figure 7B:
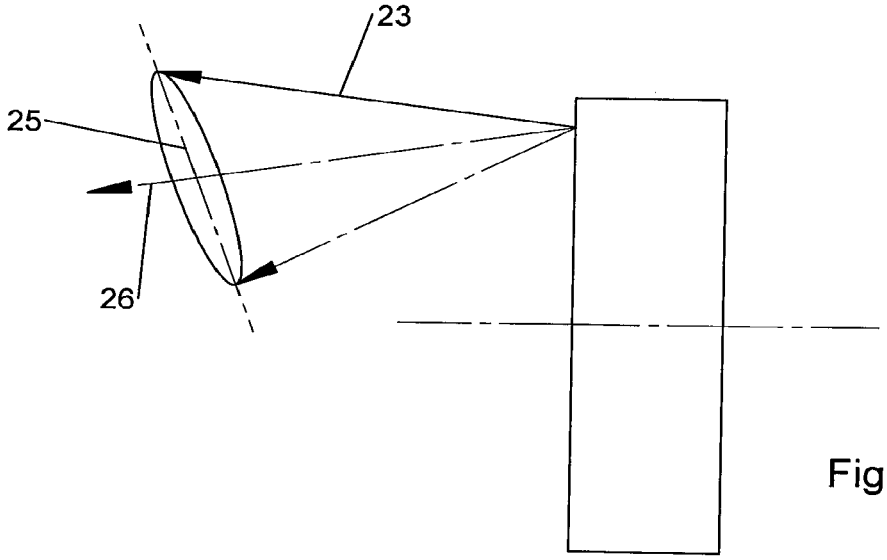

FIG. 7*b* is a diagrammatic side view of the embodiment shown in FIG. 7*b* showing the stream of droplets.

Figure 8A:
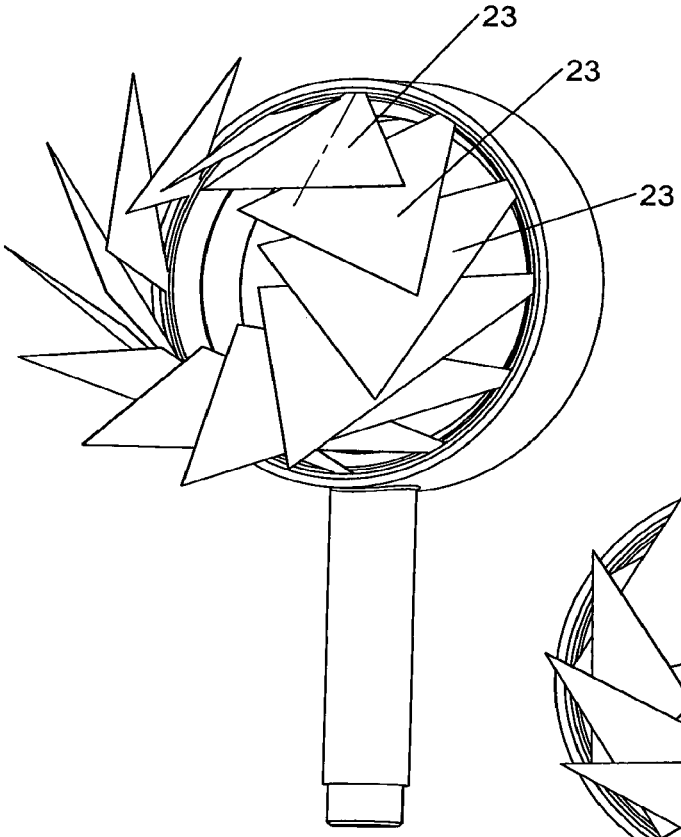

FIG. 8*a* is a diagrammatic perspective view of an alternative version of the embodiment shown in FIGS. 7*a* and 7*b*, with the droplet streams represented diagrammatically as flat "fans".

Figure 8B:
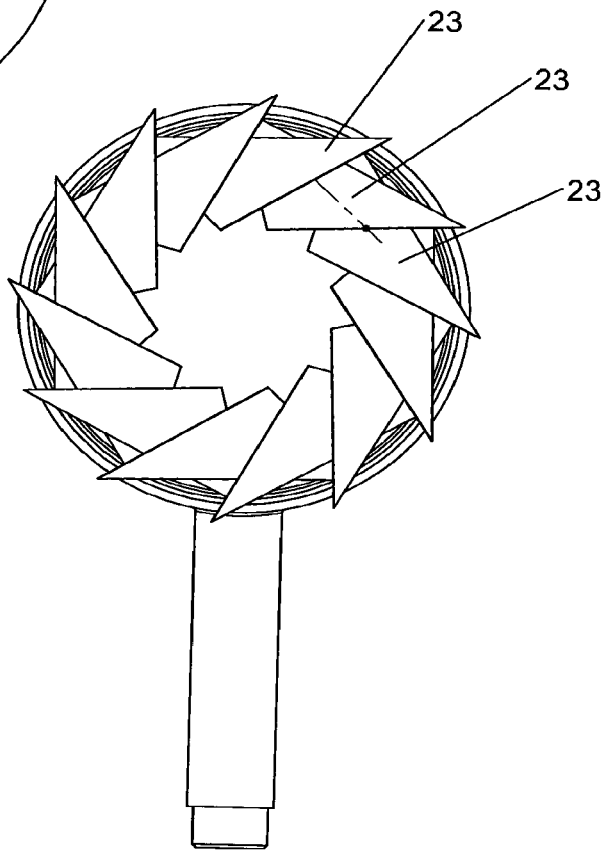

FIG. 8*b* is a diagrammatic front view of the version shown in FIG. 8*a*.

Figure 9:
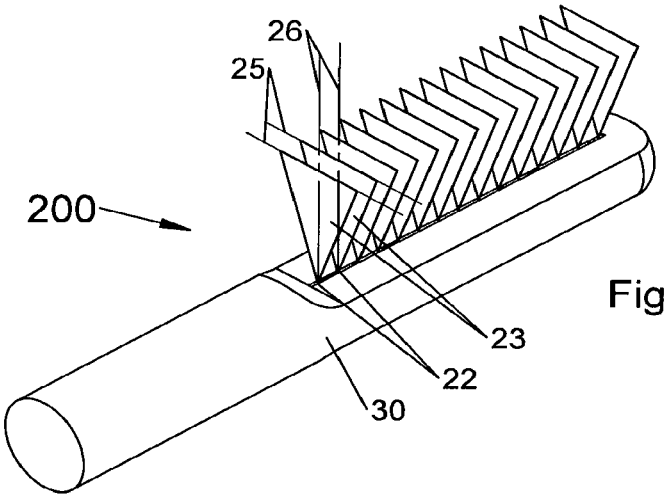

FIG. 9 is a diagrammatic perspective view of a further embodiment of the invention, with the droplet streams represented diagrammatically as flat "fans".

Figure 10:
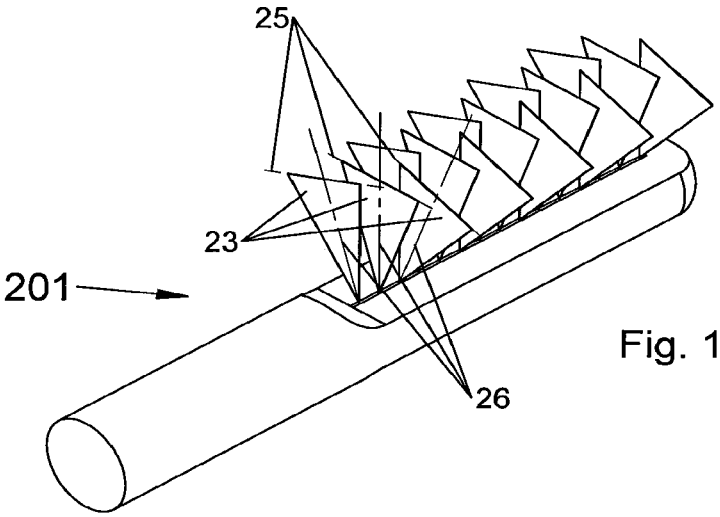

FIG. 10 is a diagrammatic perspective view of another embodiment of the invention, with the droplet streams represented diagrammatically as flat "fans".

Figure 11:
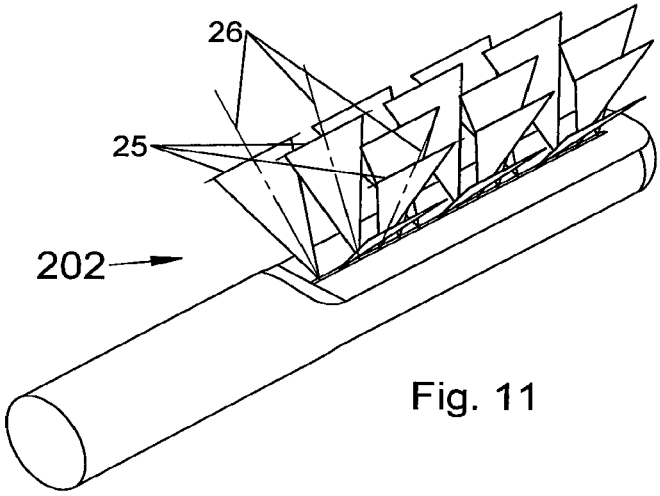

FIG. 11 is a diagrammatic perspective view of a still further embodiment of the invention, with the droplet streams represented diagrammatically as flat "fans".

Figure 12:
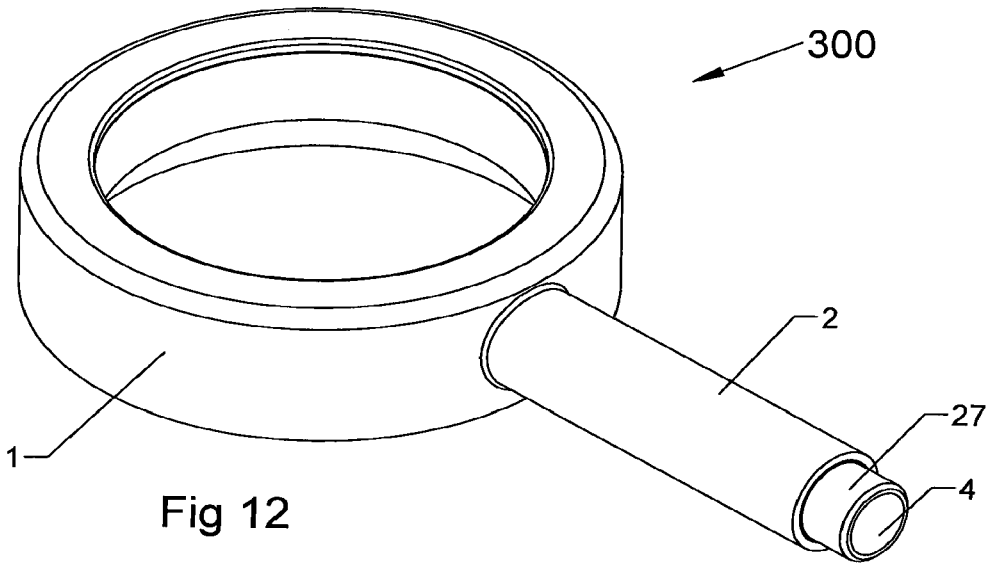

FIG. 12 is a top perspective view of an alternative embodiment of the shower head shown in FIGS. 1 to 4.

Figure 13:
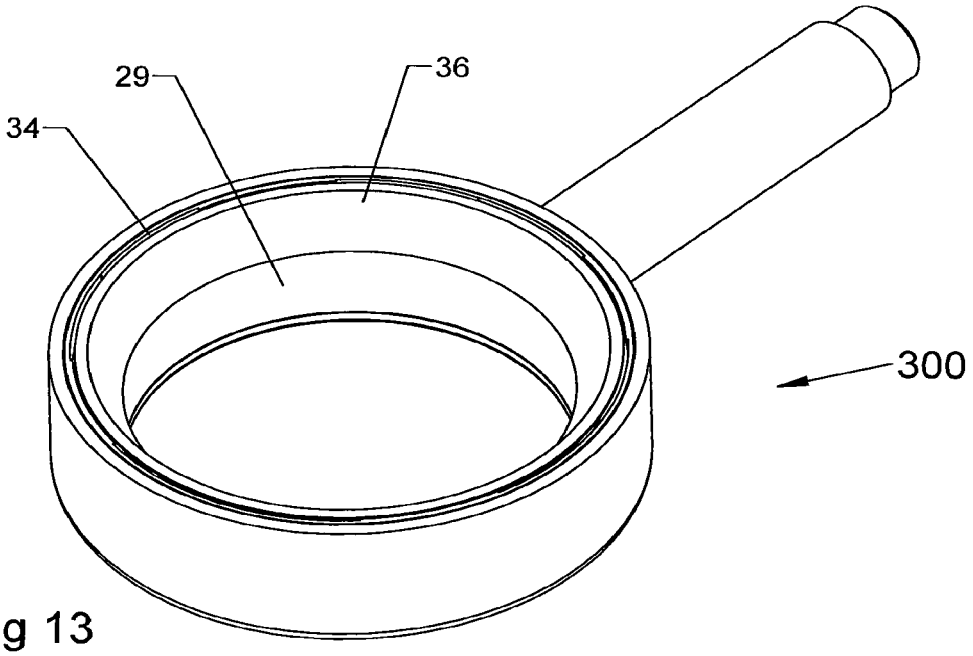

FIG. 13 is a perspective view from beneath of the shower head shown in FIG. 12.

Figure 14:
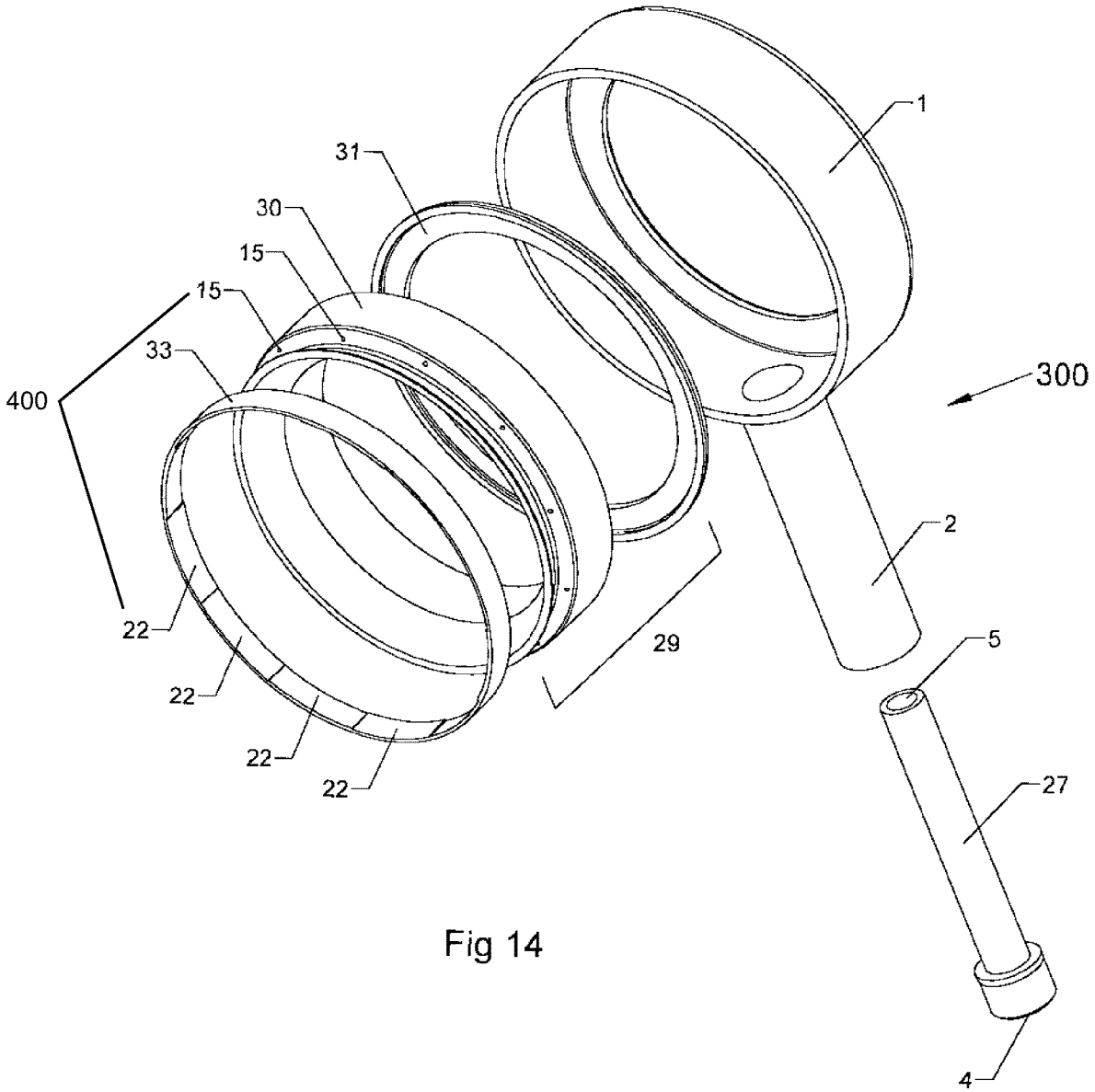

FIG. 14 is an exploded perspective view of the shower head shown in FIG. 12.

Figure 15:
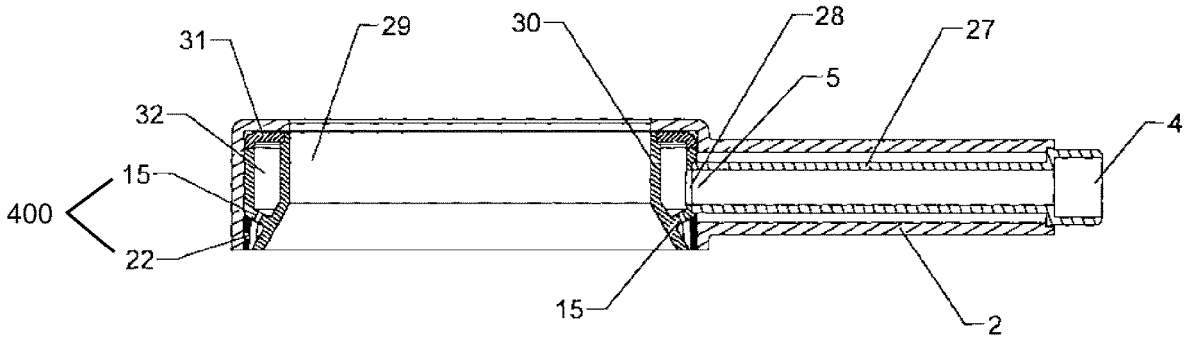

FIG. 15 is a cross-section side view of the shower head shown in FIG. 12.

FIG. 16*a* is a diagrammatic perspective view of a jet of water directed at an impingement surface portion having a concave profile.

FIG. 16*b* is a diagrammatic perspective view of a jet of water directed at an impingement surface portion having a convex profile.

FIG. 16*c* is a diagrammatic perspective view of a jet of water directed at an impingement surface portion having an undulating profile.

FIG. 17 is a diagrammatic longitudinal cross-section view of a curved impingement surface portion.

Figure 1:
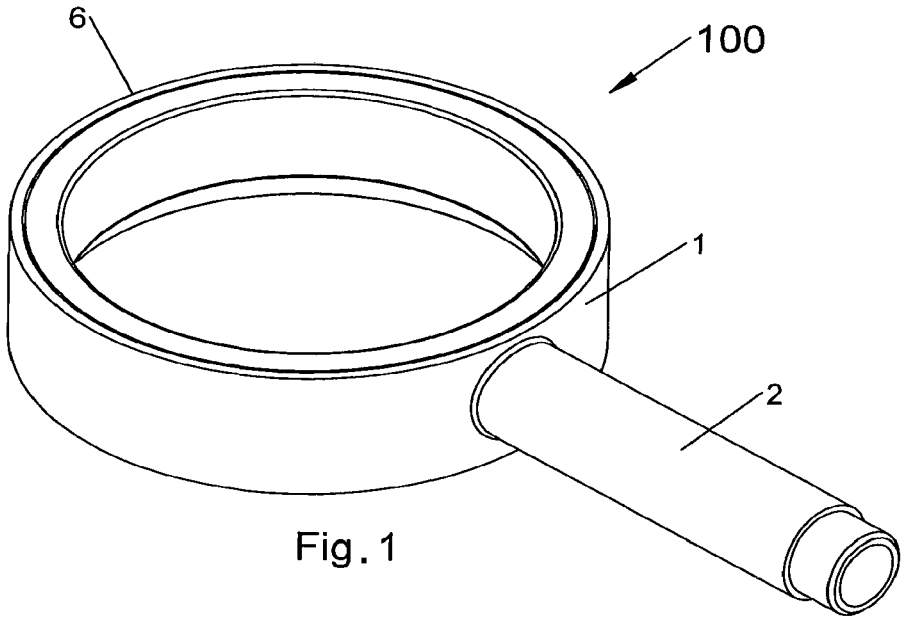
FIG. 1 is a perspective view of a shower head according to one embodiment of the invention.
Figure 2:
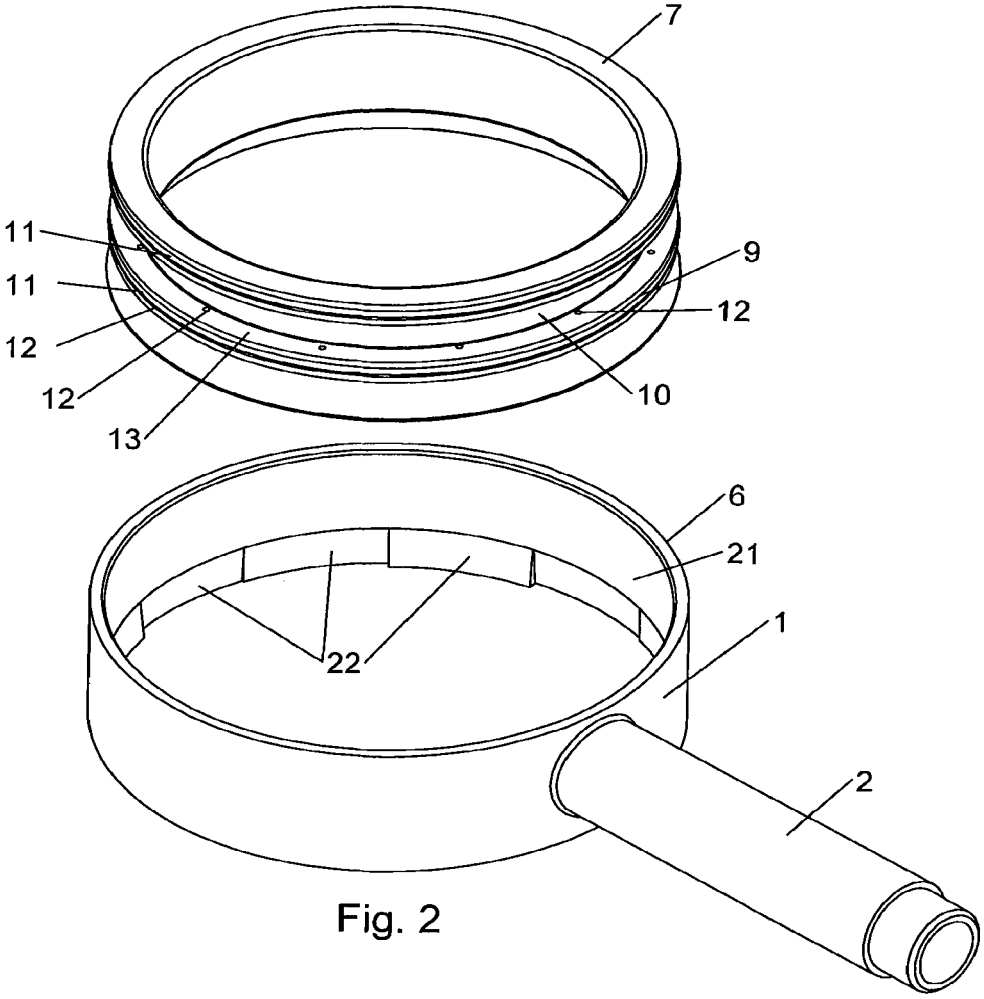
FIG. 2 is an exploded perspective view of the shower head of FIG. 1.
Figure 3:
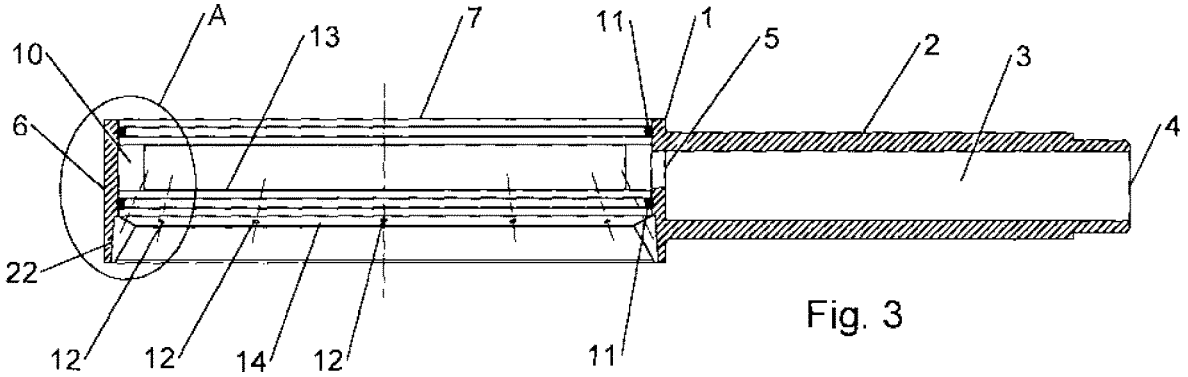
FIG. 3 is a side view of the shower head of FIG. 1 with a section of the housing removed to show the annular body.
Figure 4:
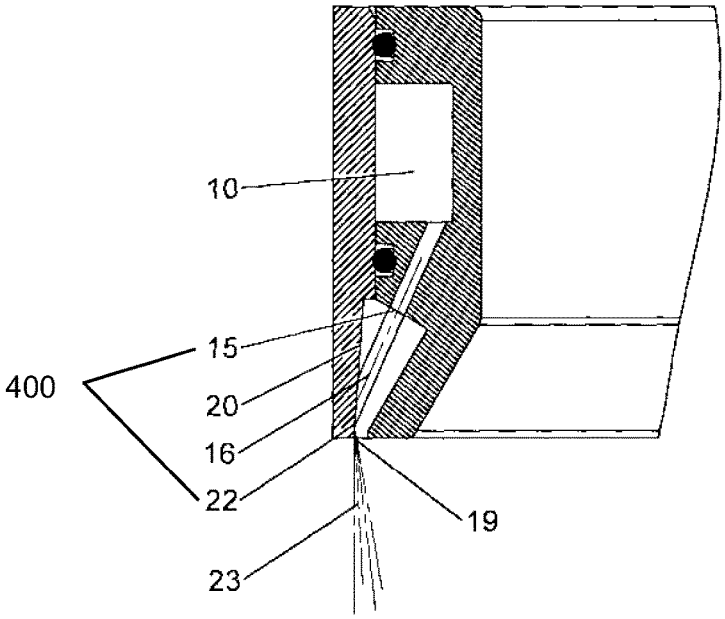
FIG. 4 is an enlarged view of section A of FIG. 3, with the shower head in use.

FIG. 18 is a further enlarged view of the area A of FIG. 4.

BEST MODES FOR PERFORMING THE INVENTION

Referring first to FIGS. 1, 2, 3 and 4, a spray head which is adapted for use as a shower head according to one embodiment of the present invention is generally referenced by arrow 100. In the embodiment shown the shower head comprises an outer housing 1. The housing 1 has a handle portion 2 provided which defines an internal conduit 3. The conduit 3 has an inlet 4 and an outlet 5.

The housing has an annular portion 6 inside which an annular body 7 is engaged. The radially outer surface 9 of the body 7 is provided with an annular groove 10. Sealing means, typically O-ring seals 11, may be provided on either side of the annular groove 10. Alternatively the annular body may be fixed to the housing in a watertight manner through the use of a suitable adhesive or welding technique.

A plurality of apertures 12 extend from a wall 13 of the annular groove 10 to a radially extending wall 14 of the annular body 7. The apertures 12 define nozzles 15 (best seen in FIG. 4) for creating jets of fluid 16 when the annular groove 10 is supplied with pressurised fluid.

In a preferred embodiment a spray head which has been optimised to provide a 9 litre/minute total flow rate may be provided with between 10 and 20 apertures 12, more preferably around 15 apertures. The apertures 12 have a diameter between 0.8 mm and 2 mm if circular, although other dimensions providing substantially the same cross-sectional area may be used if non-circular apertures are used. In some embodiments the apertures may be elongate slits, for example curved elongate slits. Spray heads which are designed to provide greater overall flow rates may have an increased number of apertures 12. However, if the total cross-section of the apertures 12 is too large and the velocity of the water flowing through the apertures 12 is too low then the resulting spray may be less pleasant for the user.

Referring next to FIGS. 2, 3, 4 and 5, each nozzle 15 is shaped and dimensioned to direct a jet of fluid 16 onto a portion of an impingement surface 20 provided by a radially inner surface 21 of the annular portion 6 of the housing 1. The configuration of the impingement surface portion 22 which the jet of fluid 16 impinges on is such as to cause the jet to radiate outward, to flow to the trailing edge of the surface and to break into a stream of droplets 23. The stream of droplets is preferably relatively wide relative to its thickness, and in preferred embodiment appears as a substantially flat "fan" of water droplets.

The jet of fluid 16 typically impinges on the surface portion 22 at an angle of between around 10°-40° most preferably around 25°. Lower angles provide a narrower, more forceful spray with larger droplets, and higher angles provide a wider, softer, less controllable spray with smaller droplets.

The jet of fluid 16 preferably impinges on the surface portions between 1 mm and 14 mm from the lower or trailing edge 19 of the surface, most preferably around 2 mm. It is preferred that the jet impinge close to the edge of the surface so as to reduce the amount of energy the water flow loses to friction as it flows over the surface portion. As is described further below, the impingement surface portion 22 may be substantially flat, or may be curved along one or two axes.

Figure 5:
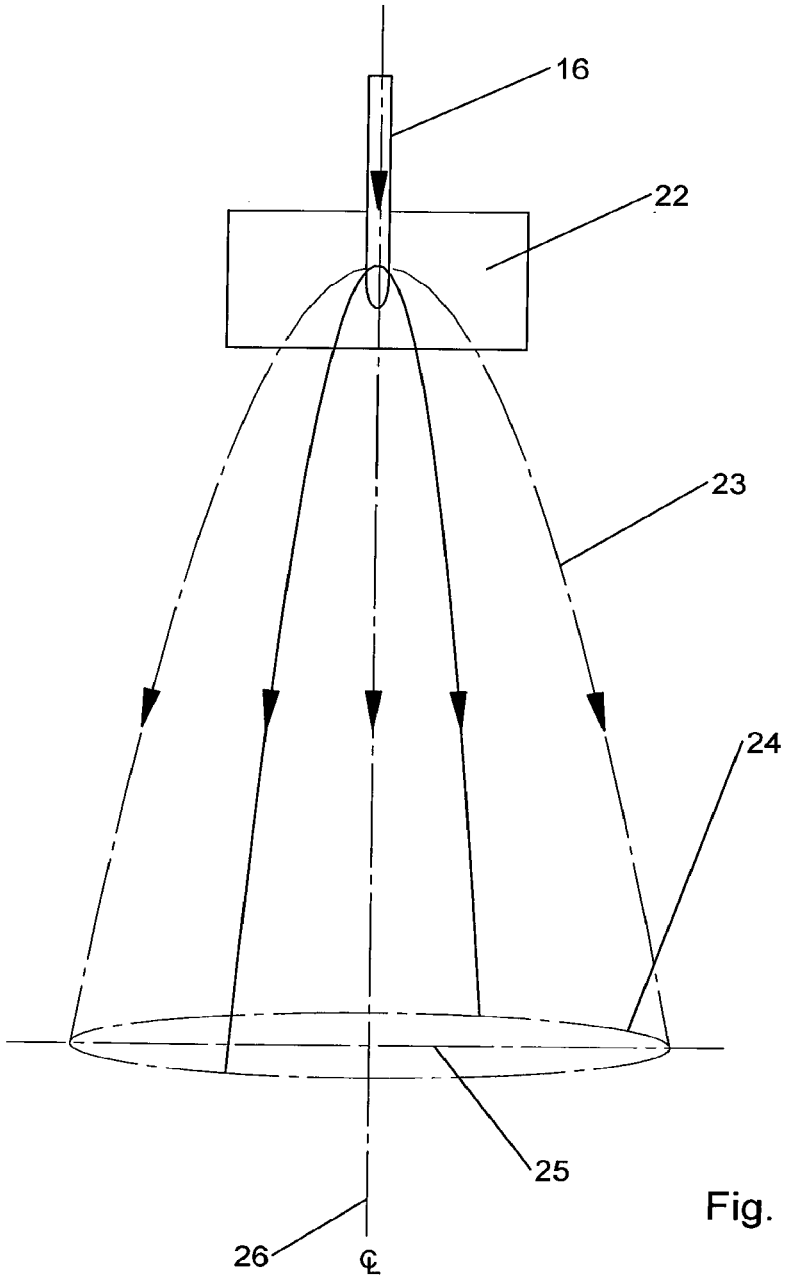
FIG. 5 is a schematic view of a stream of droplets from an impingement surface portion.

As is best seen in FIG. 5, the stream of droplets 23 from each impingement surface portion typically has an elongate transverse cross section 24, for example an elongate ellipse. The elongate cross-section 24 has a longitudinal axis 25 which is parallel to the "plane" of the stream of droplets. The stream of droplets 23 also has a geometric centreline 26, as shown.

As is described further below, the configuration of nozzle 15 and its associated impingement surface portion 22, which together form a spray stream generating formation 400, may be varied to in order to vary the angle of the geometric centreline 26 of the stream of droplets 23, the width of the stream of droplets 23 and the orientation of the longitudinal axis 25.

Those skilled in the art will appreciate that orientation of the longitudinal axis 25 of each stream of droplets is a function of both the orientation of the jet of water created by the respective nozzle 15, and the orientation of the respective impingement surface portion 22, collectively the spray stream \surface portion orientation may be used to create a stream of droplets having substantially the same geometric centreline orientation and/or longitudinal axis orientation. However, the stream of droplets produced is preferably substantially coplanar with the portion of the impingement surface which is adjacent the trailing edge of the impingement surface portion. That is, the spray does not rebound off the surface portion to any great extent, but rather flows along it to the trailing edge.

Figure 6A:
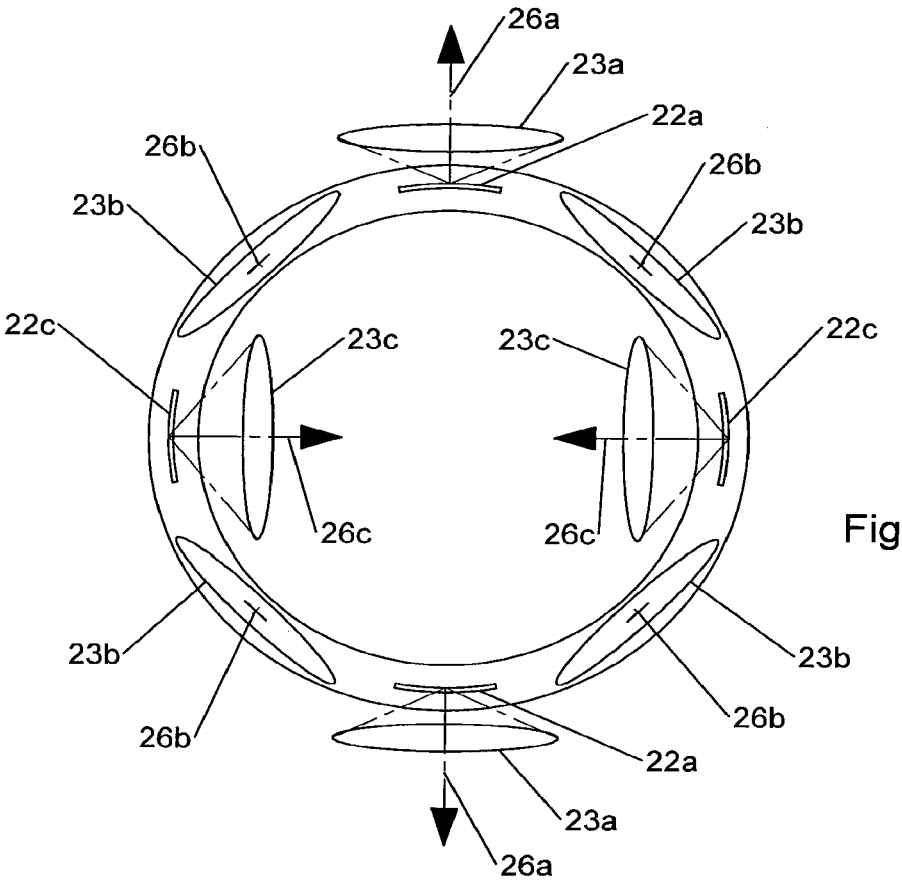
FIG. 6*a* is a diagrammatic front view of the annular portion of the shower head showing droplet streams issuing from one embodiment of the present invention.
Figure 6B:
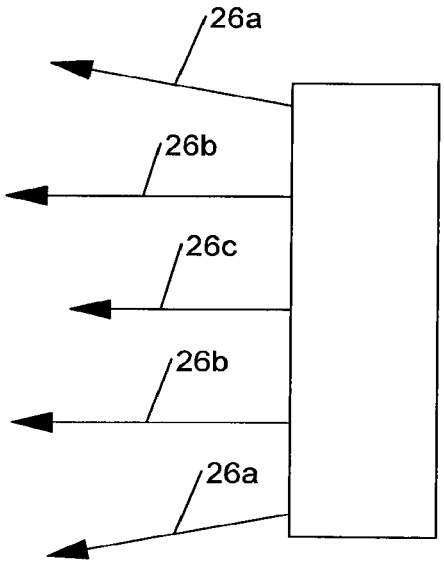
FIG. 6*b* is a diagrammatic side view of the embodiment shown in FIG. 6*a* showing the geometric centres of the streams of droplets generated.

Referring next to FIGS. 6*a* and 6*b*, in one embodiment the shower head 100 is provided with a first group of nozzles (not shown) and respective impingement surface portions 22*a* which are configured to create streams of droplets 23*a* which have diverging geometric centres 26*a*.

A second group of nozzles (not shown) and respective impingement surface portions (not shown) are configured to create streams of droplets 23*b* which have substantially parallel geometric centrelines 26*b*.

A third group of nozzles (not shown) and respective impingement surface portions 22*c* are configured to create streams of droplets 23*c* which have substantially converging geometric centrelines 26*c*.

In this way the overall spray pattern created by the shower head does not have an area in the centre which is substantially not covered, even in embodiments where the shower head has a substantially annular shape, as shown in FIGS. 1-8.

As is explained above, a number of different combinations of water jet orientation and impingement surface portion orientation may be used to create a stream of droplets having substantially the same geometric centreline orientation and/or longitudinal axis orientation.

Correspondingly, variations in the orientation of the geometric centreline may be created by varying the orientation of the water jet, the impingement surface portion, or both.

In some versions of the embodiment shown in FIGS. 6*a* and 6*b* the angle of the jets created by the nozzles in each group of nozzles may be substantially rotationally symmetrical around the centreline of the annular shower head, with the diverging, parallel and converging characteristics of the different streams of droplets 23*a*, 23*b*, 23*c* being created by differing orientations of the respective impingement surface portions 22*a*, 22*c*.

In other versions the various impingement surface portions may be rotationally symmetrical about the centreline of the annular shower head, with the variations in the spray pattern produced being a result of differences in the orientation of the water jets. In some embodiments some or all of the respective impingement surface portions may be parts of a single substantially continuous impingement surface.

In another embodiment of the invention, shown in FIGS. 7*a* and 7*b*, the orientation of the geometric centreline 26 of each stream of droplets 23 may be substantially rotationally symmetrical about the centre of the annular shower head. However, the orientation of the impingement surface portions 22 (obscured behind narrow apertures in the face of the spray head) may be non-parallel to a tangent T to a notional curve C on which the impingement surface portions 22 lie. This orientation of the impingement surface portions means that the longitudinal axis 25 of each droplet stream 23 is also non-tangential to the curve C. In this way at least part of each stream of droplets 23 is directed towards a centre of the notional curve.

FIGS. 8*a* and 8*b* show another example of an embodiment which is similar to that described above with reference to FIGS. 7*a* and 7*b*. In FIGS. 8*a* and 8*b* the droplet streams are shown diagrammatically as two dimensional sprays or "fans" of water, although those skilled in the art will appreciate that the droplet stream will in practice have a thickness, albeit a thickness which is much smaller than the width dimension.

In the embodiment shown in FIGS. 8*a* and 8*b* the longitudinal axis 25 of each stream 23 is parallel to a tangent of the curve on which the nozzles lie. The streams are directed so that the geometric centreline of each stream of droplets has a direction component in the tangential direction, and a direction component toward the centre of the circular housing (that is, the centre of the droplet stream is directed slightly inward and sideways), as best seen in FIG. 8*b*. In this way, one side of each stream of droplets is directed towards the interior of the overall spray pattern created. In this embodiment the impingement surface portions (not shown) are substantially tangential to the notional curve C, with the trailing edge of the surface portions angled slightly inward in order to impart the inward direction component to droplet stream. The nozzles (not shown) are configured to create jets of fluid which have a directional component which is tangential to the notional curve.

Referring next to FIG. 9, an alternative embodiment of a showerhead according to the present invention is generally referenced by arrow 200.

The shower head 200 has an elongate body 30. A plurality of nozzles are provided (not shown). The nozzles are arranged in a substantially collinear pattern.

The nozzles direct jets of water towards respective impingement surfaces 22, in order to create streams of droplets 23. As with the embodiments described above, the streams of droplets 23 have elongate cross-sections.

In the embodiment shown, the longitudinal axes 25 of the elongate cross-sections of the streams of droplets 23 are substantially parallel with each other, although in alternative embodiments they may be non-parallel. The elongate axes 25 are substantially orthogonal to a notional line on which the water nozzles are arranged.

The streams of droplets 23 also have geometric centrelines 26 which in the embodiment shown in FIG. 9 are also substantially parallel.

Referring next to FIG. 10, a variation of the embodiment shown in FIG. 9 is generally referenced by arrow 201. This embodiment varies from the embodiment shown in FIG. 9 in that the geometric centrelines 26 of the streams of droplets are divergent rather than parallel. Referring next to FIG. 11, a variation of the embodiment shown in FIG. 10 is generally referenced by arrow 202. In this embodiment the longitudinal axes 25 are rotated 90 degrees so that the "planes" of the droplet streams are substantially parallel to the notional line on which the nozzles lie. The geometric centrelines 26 are also divergent, as they are in the embodiment shown in FIG. 10.

Referring next to FIGS. 12-15, a variation of the embodiment shown in FIGS. 1-4 is generally referenced by arrow 300. In this embodiment, a conduit member 27 is provided within the handle portion 2. The conduit member 27 is provided with an inlet 4 and an outlet 5. The outlet 5 is sealed to an inlet 28 in the annular body 29. In this embodiment the annular body 29 comprises a main annular body 30 and a cap 31. The main annular body 30 has an internal conduit 32 which connects the inlet 28 with the nozzles 15. In contrast to the embodiments shown in FIGS. 1-4, the outer housing 1 is not subject to water pressure, and so be made of less strong material that the annular body 29 and the conduit member 27. In one embodiment the outer housing 1 may be made of ABS plastic. The annular body 29 and the conduit member 27 are preferably made from a suitable polyester polymer or a PPO/PS blend.

In the embodiment shown in FIGS. 12-15 the impingement surface portions 22 may be provided on a separate impingement surface member 33. This may allow the impingement surface member 33 to be manufactured from a different material to the outer housing 1 and/or the annular member 29. For example, in one embodiment the impingement surface member 33 may be manufactured from a material which is substantially hydrophobic, for example PTFE. This may assist in preventing large droplets from agglomerating. In another embodiment the impingement surface member 33 may be manufactured from an elastomeric material such as silicone or a thermoplastic elastomer, which will deform slightly under the pressure of the water jets. This deformation may assist in reducing limescale buildup on the impingement surface portions.

Referring next to FIGS. **16*a*-16*c*, the applicant has found that in some embodiments it is advantageous for the impingement surface portion to be curved in the longitudinal and/or transverse directions. The impingement surface portion 22 may be substantially concave in transverse cross-section, as shown in FIG. 16*a*, convex in transverse cross-section, as shown in FIG. 16*b*, or may have an undulating transverse cross-section, as shown in FIG. 16*c*. In each case, the transverse cross-section of the stream of droplets 23 produced has a shape substantially corresponding to the contour of the impingement surface portion. Impingement surface portions 22 having the profile shown in FIGS. 16*a*-16*c*** may be used in any of the embodiments described above. In some embodiments a combination of curved and substantially flat impingement surface portions may be used. In other embodiments just one type of curved profile may be used, while in still further embodiments a mixture of curved profiles may be used.

Referring next to FIG. 17, in some embodiments the overall thickness of the member 33 providing the impingement surface portion 22 may be reduced by shaping the member 33 such that the impingement surface portion 22 is curved when viewed in longitudinal cross-section. In a preferred embodiment a shower head may be provided with a plurality of impingement surface portions of this general shape, with angle A (the angle of the lower or trailing surface of the impingement surface 22) being varied between respective impingement surfaces to provide a required spray pattern, but angle B (the angle between the impinging water jet and the upper portion of the impingement surface 22) being substantially constant.

Referring next to FIGS. 13 and 18 in particular, in preferred embodiments the stream of droplets travels through an aperture in the shower head. The aperture is preferably no more than 3 mm wide, more preferably less than 1 mm. In the embodiment shown the aperture is an annular slot 34 which is provided between the impingement surface portion 22 and an adjacent surface 35 of the annular member 29. The width W of the slot 34 is preferably less than 3 mm wide when measured in a direction which is orthogonal to the plane of the impingement surface portion (in this instance the radial direction). By keeping the width of the slot as narrow as possible without impeding the spray pattern formed by the impingement surface 22, any droplets which accumulate on the interior surfaces around the impingement surface portion 22 are re-absorbed into the main spray pattern rather than falling from the showerhead as a discrete droplet or "drip". In preferred embodiments the adjacent surface 35 may be defined by an annular skirt portion 36 which is part of the annular member 29.

Those skilled in the art will appreciate that although the invention has been described with reference to a hand-held showerhead, other embodiments of the spray head are also possible, for example fixed or "drencher" type embodiments.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the scope of the appended claims.

The invention claimed is:

1. A spray head comprising:

an inlet, a plurality of nozzles, each of the plurality of nozzles including a fluid path extending through the nozzle, and a plurality of respective impingement surface portions, each of said plurality of respective impingement surface portions being located across an open space from a respective one of said plurality of nozzles, each of the plurality of respective impingement surface portions including a periphery defining a trailing edge, wherein each nozzle of said plurality of nozzles is configured and arranged to produce, in use, a respective jet of fluid which is directed toward the respective one of the plurality of respective impingement surface portions, each respective jet of fluid exiting unimpeded from the respective one of the plurality of nozzles, traveling across said open space, wholly impacting one of the plurality of respective impingement surface portions, wherein each of the plurality of respective impingement surface portions are configured and arranged to wholly receive the jet of fluid, the whole jet of fluid flowing to the respective trailing edge, and breaking into a respective stream of droplets having an elongate transverse cross-section and a geometric centreline;

wherein said plurality of nozzles comprises a first set of the plurality of nozzles and a second set of the plurality of nozzles, each nozzle in the first set of nozzles being directed towards a respective first impingement surface portion and each nozzle in the second set of nozzles being directed towards a respective second impingement surface portion, wherein, in use, each jets of fluid issuing from respective nozzles of the first and second sets of nozzles wholly impact on the respective impingement surface portions and break into a stream of droplets, wherein respective geometric centrelines of streams of droplets from the first impingement surface portions being at a first stream angle relative to a common spray axis of the spray head, and respective geometric centrelines of the streams of droplets from the second impingement surface portions being at a second stream angle relative to a common spray axis of the spray head, wherein each nozzle in the first set of nozzles being positioned at a first angle relative to the common spray axis of the spray head and each nozzle in the second set of nozzles being positioned at a second angle relative to the common spray axis, and wherein said first angle differs from said second angle.

2. The spray head of claim 1, wherein each of the plurality of nozzles are positioned at an angle between 10 degrees and 40 degrees relative to the respective plurality of impingement surface portions.

3. The spray head of claim 1, wherein each of the plurality of nozzles are positioned relative to the respective impingement surface portion so that each respective jet of fluid from the plurality of nozzles are configured and arranged to impact on the respective impingement surface portion between 1 mm and 14 mm from an edge of the respective impingement surface portion.

4. The spray head of claim 1, wherein each respective stream of droplets travels through an aperture in the spray head, and is unimpeded by the aperture.

5. The spray head of claim 4, wherein the aperture is a slot.

6. The spray head of claim 4, wherein the aperture has a width of 3 mm or less.

7. The spray head of claim 1, wherein each of the plurality of nozzles are aligned relative to the respective impingement surface portion so that a longitudinal axis of each of the plurality of nozzles intersects the respective impingement surface portion between 1 mm and 14 mm from an edge of the respective impingement surface portion.

8. The spray head of claim 1, wherein the respective impingement surfaces are further configured and arranged to form the respective stream of droplets where the elongate transverse cross section of each stream of droplets has a longitudinal axis, and the longitudinal axes of at least two respective streams of droplets are parallel to each other.

9. The spray head of claim 8, wherein the longitudinal axes of the respective streams of droplets are parallel.

10. The spray head of claim 1, wherein the respective impingement surfaces are further configured and arranged to form respective stream of droplets with a geometric centreline, and the geometric centrelines of at least two of the respective streams of droplets are parallel to each other.

11. The spray head of claim 10, wherein the respective impingement surfaces are further configured and arranged to form the droplets where at least two respective droplets of the respective stream of droplets have diverging geometric centrelines.

12. The spray head of claim 1, wherein the geometric centrelines of streams of droplets from the first impingement surface portions converge, and the geometric centrelines of the streams of droplets from the second impingement surface portions are non-convergent.

13. The spray head of claim 12, wherein the geometric centrelines of the streams of droplets from the second impingement surface portions are parallel.

14. The spray head of claim 12, wherein the geometric centrelines of the streams of droplets from the second impingement surface portions are divergent.

15. The spray head of claim 12, wherein the geometric centrelines of the streams of droplets from the second impingement surface portions are parallel, and said plurality of nozzles comprises a third set of the plurality of nozzles, each nozzle in the third set of nozzles being directed towards a respective third impingement surface portion, wherein, in use, jets of fluid issuing from the third set of nozzles impact on the respective third impingement surface portions and break into a stream of droplets, wherein the third set of nozzles and third impingement surface portions are configured such that respective geometric centrelines of the streams of droplets are divergent.

16. The spray head of claim 1, wherein the plurality of nozzles are arranged along a notional curved line, such that jets of fluid issuing respectively, in use, from at least some of said nozzles have a direction which includes a component which is tangential to the notional curved line.

17. The spray head of claim 1, wherein the plurality of nozzles are arranged along a notional curved line, and wherein the elongate transverse cross section of each respective stream of droplets has a longitudinal axis, and the longitudinal axis of each stream of droplets is non-tangential to the notional curved line.

18. The spray head of claim 17, wherein the notional curved line is circular or semi-circular.

19. The spray head of claim 1, further including an outer housing having an annular portion with a central void, and a handle portion.

20. The spray head of claim 19, further including an annular body and, wherein the plurality of nozzles are defined by apertures in the annular body.

21. The spray head of claim 1, wherein each nozzle in the first set of nozzles being positioned at a first angle relative to the respective first impingement surface portion and each nozzle in the second set of nozzles being positioned at a second angle relative to the respective second impingement surface portion, and wherein said first angle differs from said second angle.

22. The spray head of claim 1, wherein each impingement surface portion is a single continuous surface.

23. The spray head of claim 22, wherein each impingement surface portion is a flat surface.

* * * * *